US008235142B2

(12) United States Patent
Carlson et al.

(10) Patent No.: US 8,235,142 B2
(45) **Date of Patent: *Aug. 7, 2012**

(54) UNDERGROUND BORING MACHINE AND METHOD FOR CONTROLLING UNDERGROUND BORING

(75) Inventors: Robin W. Carlson, Pella, IA (US); Randy R. Runquist, Knoxville, IA (US)

(73) Assignee: Vermeer Manufacturing Company, Pella, IA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/785,985

(22) Filed: May 24, 2010

(65) Prior Publication Data

US 2010/0230168 A1 Sep. 16, 2010

Related U.S. Application Data

(63) Continuation of application No. 11/654,195, filed on Jan. 17, 2007, now Pat. No. 7,721,821.

(60) Provisional application No. 60/759,505, filed on Jan. 17, 2006.

(51) Int. Cl.
*E21B 44/00* (2006.01)

(52) U.S. Cl. ..... 175/24; 175/40; 175/62

(58) Field of Classification Search ..... 175/24, 175/40, 62
See application file for complete search history.

(56) References Cited

U.S. PATENT DOCUMENTS

| | | | | |
|---|---|---|---|---|
| 4,582,146 | A | 4/1986 | Becker | |
| 5,746,278 | A | 5/1998 | Bischel et al. | |
| 6,749,029 | B2 | 6/2004 | Alft et al. | |
| 7,721,821 | B2 * | 5/2010 | Carlson et al. | 175/24 |
| 2003/0173113 | A1 | 9/2003 | Alft et al. | |
| 2003/0205409 | A1 | 11/2003 | Koch et al. | |
| 2004/0028476 | A1 | 2/2004 | Payne et al. | |
| 2005/0073195 | A1 | 4/2005 | Popilek | |

* cited by examiner

*Primary Examiner* — Giovanna Wright
(74) *Attorney, Agent, or Firm* — Merchant & Gould P.C.

(57) ABSTRACT

A method and system for controlling a horizontal directional drilling machine having a boring tool. A rate of rotation and a rate of thrust are selected by an operator. Controls allow an automatic boring operation mode to be initiated to maintain the selected rate of rotation and thrust without further input from the operator. Periodically, when the rotation and thrust are interrupted, such as to modify the drill string, the automatic boring operation mode is interrupted. The automatic boring operation mode may be resumed without requiring the operator to select the rate of rotation and rate of thrust. The rate of rotation is resumed before the rate of thrust to reduce drill string shock loads and increase drilling performance.

20 Claims, 7 Drawing Sheets

UNDERGROUND BORING MACHINE AND METHOD FOR CONTROLLING UNDERGROUND BORING

CROSS REFERENCE TO RELATED APPLICATIONS

This application is a continuation of application Ser. No. 11/654,195, filed Jan. 17, 2007, which application claims the benefit of provisional application Ser. No. 60/759,505, filed Jan. 17, 2006 which applications are incorporated herein by reference in their entirety.

FIELD OF THE INVENTION

The present invention relates generally to underground boring machines and methods for controlling underground boring. More particularly, the present invention relates to underground boring machines for use in horizontal directional drilling and to an improved method of, and apparatus for, automatic control of boring functions.

BACKGROUND OF THE INVENTION

Utility lines for water, electricity, gas, telephone and cable television are often run underground for reasons of safety and aesthetics. Sometimes, the underground utilities are buried in a trench that is then back filled. However, trenching can be time consuming and can cause substantial damage to existing structures or roadways. Consequently, alternative techniques such as horizontal directional drilling ("HDD") are becoming increasingly popular.

A typical horizontal directional drilling machine includes a frame on which is mounted a rotational drive mechanism that can be slidably moved along the longitudinal axis of the frame, to rotate a drill string about its longitudinal axis while sliding along the frame to advance the drill sting into, or withdraw it from, the ground. The drill string comprises one or more drill rods attached together in a string.

A boring tool is installed onto the end of the drill string furthest away from the horizontal HDD machine. For example, a drill bit is used when the drill string is being advanced into the ground where there is no existing hole. Similarly, a back reamer is used to enlarge a bored hole and is used when the drill string is being withdrawn after a hole is cut. These boring tools may include a wide variety of soil cutting devices tailored for specific formations. Examples include cutting edges that shear the soil and compression elements that concentrate longitudinal force from the drill string onto a concentrated area to fracture the ground when boring in rock conditions. In either case, the operation of the boring tools includes both rotational and longitudinal (or thrust) motion.

Boring machines include controls that allow the operator to control both the rotational movement and the longitudinal movement, also referred to as thrust, of the drill string and consequently of the boring tool. Typically, the magnitude of the rotational movement and thrust movement are proportional to the position of the controls. The optimum setting of rotational movement and thrust movement depends on various factors such as the soil conditions, the formation, and the type of boring tool. It is therefore necessary for the operator to establish the optimum setting based on each unique boring situation. However, in some situations the soil conditions can change rapidly, particularly as the boring tool advances through the soil and encounters soils of different densities and types, such as clay soil and rocks. Under these circumstances, an operator may be not be able to adjust the settings quickly enough to compensate for these variations. U.S. Pat. No. 5,746,278, to Bischel, herein incorporated by reference, discloses a control system that automatically adjusts the rotational movement and thrust movement settings, independently from the inputs of the operator.

In some conditions, the boring process requires maintaining consistent values of the rotational and thrust movement settings, which in turn requires the operator to maintain the controls in the appropriate position for relatively long periods of time. It can be difficult, however, for the operator to accurately maintain the positions of the controls for relatively long periods of time without becoming fatigued or losing attentiveness. In these conditions, the control system can be set to automatically maintain the boring parameters once the operator has determined the optimum levels of rotation and thrust. A control system configured in this way allows the operator to first manually set the desired rotational movement and thrust movement parameters, and then to maintain this state by depressing a separate control (such as a switch) that causes the control system to maintain these settings when the operator lets go of the controls. Although the controls typically return to their neutral positions (the position where the rotational and thrust movement are set to zero), the rotation and thrust movement settings are maintained automatically at the preferred operating state.

The boring operation must generally, however, be periodically interrupted, such as when a drill rod needs to be added to the drill string during boring or when a drill rod needs to be removed from the drill string during backreaming. When the boring process is resumed, the drill bit must be transitioned from a stationary state to a drilling state. A drilling state may generally be defined as including rotation and thrust against the soil. To accomplish this, the control system may further be configured to resume the rotational movement and thrust movement parameters that were present before the boring operation was interrupted. However, when the control system attempts to quickly resume the rotational and thrust movement settings, high loads can be encountered in the boring tool and drill string. These high loads can damage the boring tool and drill string and lead to poor drilling performance. Therefore, there is a need for an optimized boring resumption process and an apparatus for implementing the same.

SUMMARY OF THE INVENTION

One aspect of the invention includes a method for controlling an underground boring tool. The method includes setting a rate of rotation of the boring tool and setting an axial thrust of the boring tool. As indicated above, the set rate of rotation and axial thrust of the boring tool are generally interrupted periodically, such as to add a drill rod to the drill string. Following the interruption, the set rate of rotation of the boring tool is resumed first before the set axial thrust of the boring tool is resumed at a set rate of increasing axial thrust. While the term periodically is used herein to describe the interruptions in the drilling state, it will be appreciated, however, only one such interruption of the drilling state and a resumption is necessary to practice the principles of the present invention.

A further aspect of the invention includes an apparatus for controlling an underground boring tool. The apparatus includes a hydraulic system for imparting rotational motion to the drill string at a controllable speed of rotation or to generate a controllable level of torque, in response to the position of a first control, and thrusting motion at a controllable speed or to generate a controllable level of axial thrust force, in response to the position of a second control, to a boring tool at the distal end of the drill string. The apparatus also includes a third control for generating a rotation setting signal and a thrust setting signal in response to the position of the controls, an indicator for generating an automatic boring mode signal, and a fourth control for generating an automatic boring mode cancel signal. Furthermore, the apparatus includes a controller for receiving input signals including rotation and thrust setting signals, automatic boring mode signals, and automatic boring mode cancel signals from the controls, for generating rotational motion and thrusting motion control signals in response to the input signals, and for communicating said motion control signals to operatively control said hydraulic system.

Yet another aspect of the invention includes an apparatus for controlling an underground boring tool. The apparatus includes a hydraulic system for imparting rotational motion at a controllable speed of rotation or to generate a controllable level of torque, in response to the position of a first control, and thrusting motion at a controllable speed or to generate a controllable level of axial thrust, in response to the position of a second control, to a boring tool. The apparatus also includes a third control for generating a rotation setting signal and a thrust setting signal in response to the position of the controls, a fourth operator actuated control that generates a signal for incrementing and decrementing a rotational motion setting, and a fifth operator actuated control that generates a signal for incrementing and decrementing an axial thrust setting. The apparatus also includes a controller for receiving input signals from the first, second, third, fourth, and fifth operator actuated controls, for generating rotational motion and axial thrust control signals in response to the input signals, and for communicating said motion control signals to operatively control said hydraulic system.

While the invention will be described with respect to preferred embodiment configurations and with respect to particular devices used therein, it will be understood that the invention is not to be construed as limited in any manner by either such configuration or components described herein. Also, while the particular types of hydraulic pumps and motors are described herein, it will be understood that such particular mechanisms are not to be construed in a limiting manner. Instead, the principles of this invention extend to any environment in which automatically maintaining and/or resumption of a drilling state with predetermined rotation and axial thrust settings are desired. These and other variations of the invention will become apparent to those skilled in the art upon a more detailed description of the invention.

The advantages and features which characterize the invention are pointed out with particularity in the claims annexed hereto and forming a part hereof. For a better understanding of the invention, however, reference should be had to the drawings which form a part hereof and to the accompanying descriptive matter, in which there is illustrated and described a preferred embodiment of the invention.

BRIEF DESCRIPTION OF THE DRAWINGS

The accompanying drawings, which are incorporated herein and constitute a part of the specification, illustrate several aspects of the invention and together with the description, serve to explain the principles of the invention. A brief description of the drawings is as follows.

DETAILED DESCRIPTION

Figure 1:
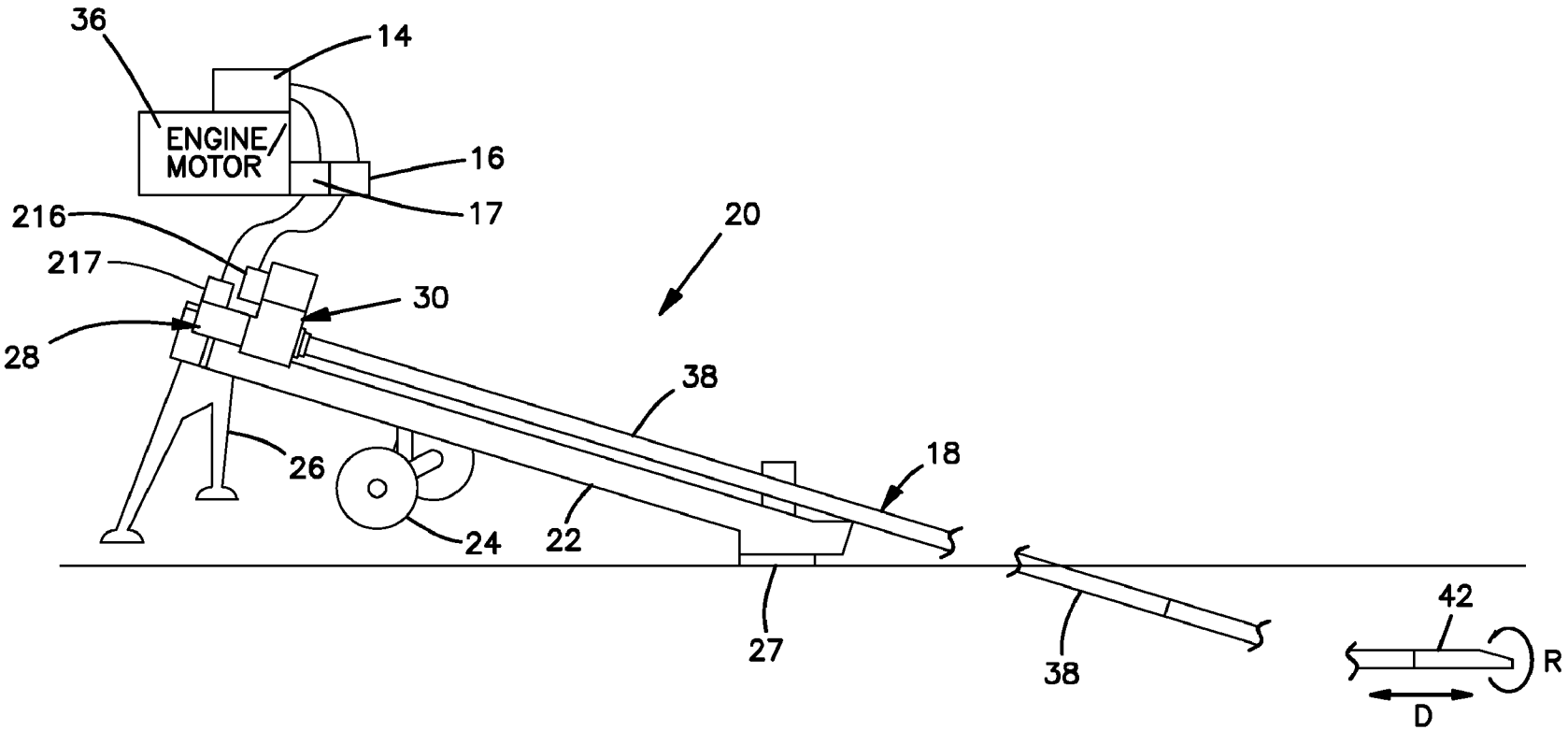
FIG. 1 illustrates a horizontal directional drilling machine.

With reference now to the various drawing figures in which identical elements are numbered identically throughout, a description of various exemplary aspects of the present invention will now be provided. The preferred embodiments are shown in the drawings and described with the understanding that the present disclosure is to be considered an exemplification of the invention and is not intended to limit the invention to the embodiments disclosed.

A horizontal directional drilling machine 20, illustrated in FIG. 1, includes a frame 22 on which is mounted a rotational drive mechanism 30 that is slidably moved along a longitudinal axis of the frame 22. In one embodiment, horizontal directional drilling machine 20 includes a rear stabilizer 26 and front stabilizer 27 for positioning and stabilizing the machine 20 at the drilling site, and a wheel assembly 24 for supporting the machine during transport between job sites. A drill string 18 comprises a boring tool 42 designed to engage the soil and one of more drilling rods 38 that transmit forces from machine 20 to the boring tool 42. The rotational drive mechanism 30 typically includes a gearbox and a drive spindle that rotates the drill string 18 about its longitudinal axis, the rotational power being preferably provided by hydraulic motor 216. The horizontal directional drilling machine 20 also includes a thrust drive mechanism 28 that typically includes gears or sprockets to move the drive mechanism 28 up and down the frame 22 to advance the drill sting 18 into, or withdraw it from, the soil. The thrust power is preferably provided by hydraulic motor 217. In some embodiments, an engine 36 drives hydraulic pumps 16 and 17, which pressurize fluid that is transferred to hydraulic motors 216 and 217.

The hydraulic systems can be either open loop where the fluid is transferred from a hydraulic reservoir 14 through the pumps to the motors 216, 217 and back to the reservoir 14, or they can be hydrostatic where the fluid is substantially in a closed loop—being transferred between the pump and the motor. In either system the pumps 16, 17 and motors 216, 217 are matched, such that by controlling the flow rate of the hydraulic fluid, the speed of rotation of the output shafts of the motors is controlled and can be inferred. The pumps are typically variable displacement pumps capable of producing variable output flow rates, proportional to an electrical current provided by a control system. The output speed of the pumps is proportional to the output flow rates. While the speed can be controlled, the pressure of the hydraulic fluid can be monitored to infer the torque being generated by the motor, which is directly proportional to the longitudinal force or rotational torque being generated. Other embodiments are possible, for instance wherein rotational and thrust drive mechanisms could be actuated by different hydraulic drives (e.g., such as hydraulic cylinders).

Some embodiments may also include a water flow mechanism that transmits water through the drill string 18 to the vicinity of the boring tool 42, where the water flow entrains cut soil particles and removes them from the hole. The horizontal directional drilling machine 20 may also include a greater for lubricating various moving components (not shown).

Figure 2:
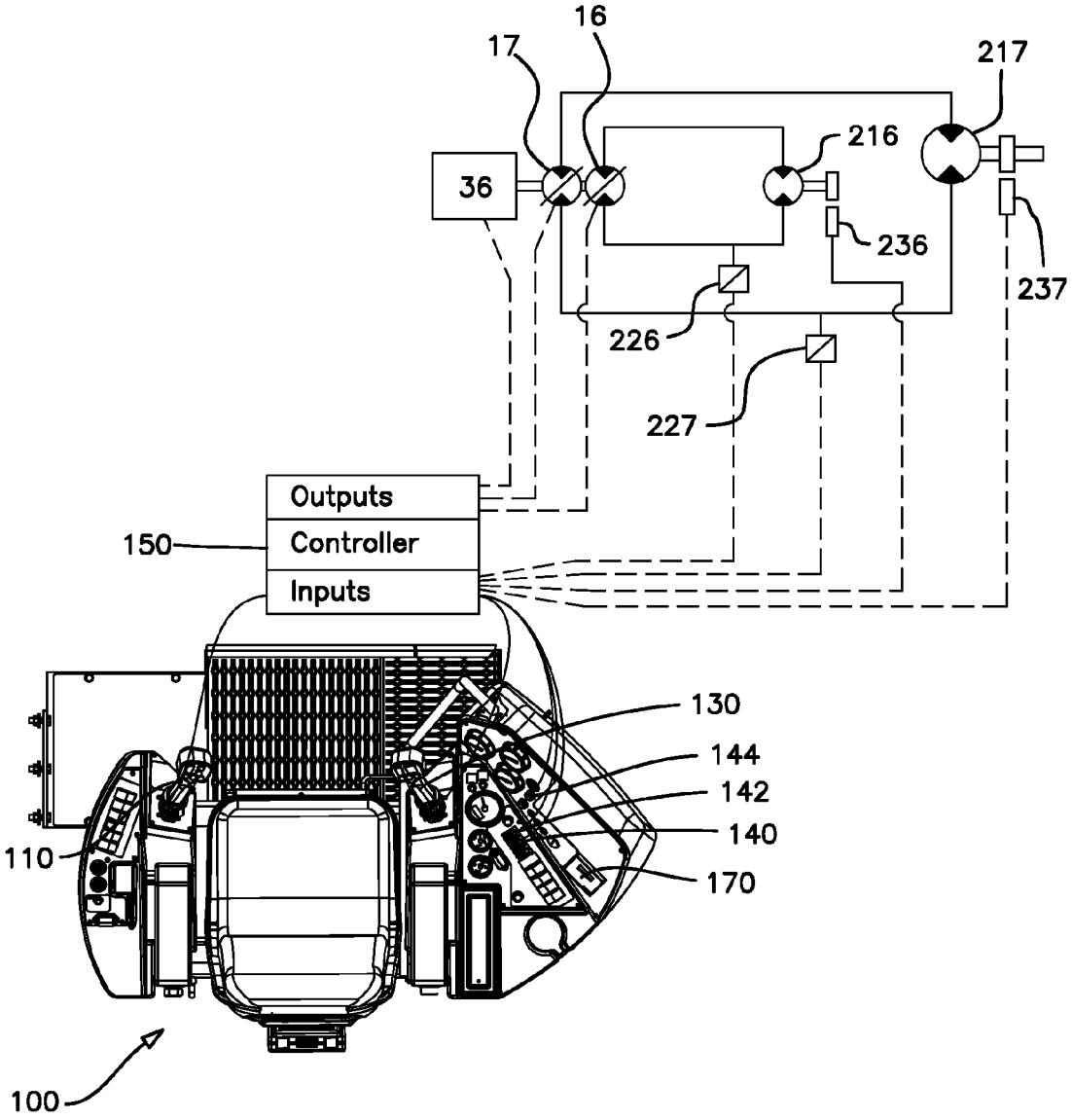
FIG. 2 illustrates the operator control station of a horizontal directional drilling machine according to the principles of the present invention.

FIG. 2 illustrates an exemplary operator control station 100 for a horizontal directional drilling machine 20. Operator control station 100 includes rotational control 110 and thrust control 130 that provide inputs to a controller 150. Many embodiments of controls 110 and 130 are usable. For example, in one usable embodiment, each of controls 110 and 130 comprise a control lever. In such an embodiment, control levers 110, 130 each produce an electrical signal that is proportional to the position of the control lever relative to a center position. The electrical signal is provided as an input to a controller 150.

In one embodiment, when the control lever 110, 130 is moved away from the center position, the electrical signal that is generated corresponds to increased rotational torque (and/or rate of rotational movement) or axial thrust force (and/or rate of axial movement), respectively. As the control lever 110, 130 is moved closer toward the center position, the generated electrical signal corresponds to decreased rotational torque (and/or rate of rotational movement) or axial thrust force (and/or rate of axial movement), respectively. In one embodiment, when the control lever 110 is moved in the forward direction, away from the operator (best seen in FIG. 3, with the direction designated at 200), the generated electrical signal corresponds to counter-clockwise rotational movement of the drill string, as viewed looking at the end of the drill string. Alternatively, when the control lever 110 is moved in the backwards direction, toward the operator (best seen in FIG. 3, with the direction designated at 201), the electrical signal that is generated corresponds to the opposite direction, clockwise rotational movement. Likewise, in one embodiment, when control lever 130 is moved forward, away from the operator, the electrical signal that is generated corresponds to forward movement of the drill string into the soil. Alternatively, when control lever 130 is moved in the backwards direction, toward the operator, the electrical signal that is generated corresponds to backwards movement of the drill string back toward the machine.

When either of control lever 110, 130 is in the center position, the electrical signal that is generated corresponds to a neutral condition where the rotational or thrust movement respectively is set to zero. A spring or other biasing mechanism is provided to return each of the control levers to the center position, so that if an operator does not hold the lever, it returns to its centered, neutral position such that the rotational or thrust motion settings are set to zero.

The controller 150 generates outputs, in response to various inputs, to control the hydraulic system. The system includes the hydraulic pumps 16 and 17 of the drilling machine 20. The hydraulic motors 216, 217 are driven by the hydraulic fluid in a known manner to create rotational and thrust movement of the boring tool 42 and drill string 18. As noted above, this control is typically a variable electrical current, wherein a certain electrical current will cause the pump to create a certain hydraulic flow rate. The output shaft of the motor thereby rotates at a certain speed of rotation. This is typically independent of the pressure in the fluid. The control systems are typically designed to provide speed control that is independent of load. The control systems typically further include pressure transducers 226 and 227 that provide feedback to the control system indicating the pressure in the circuits, and can further include speed sensors 236 and 237 for measuring the output speed of the motors 216 and 217, respectively.

Figure 4:
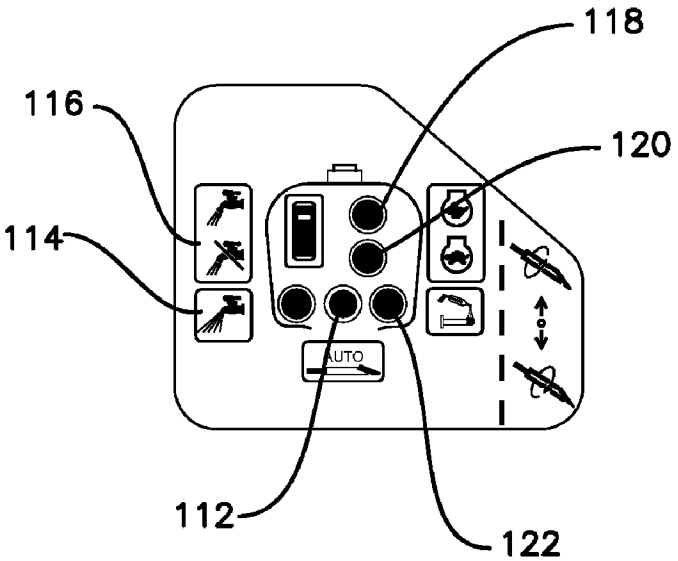
FIG. 4 illustrates a label identifying the function of the controls found on the control lever of FIG. 3.
Figure 3:
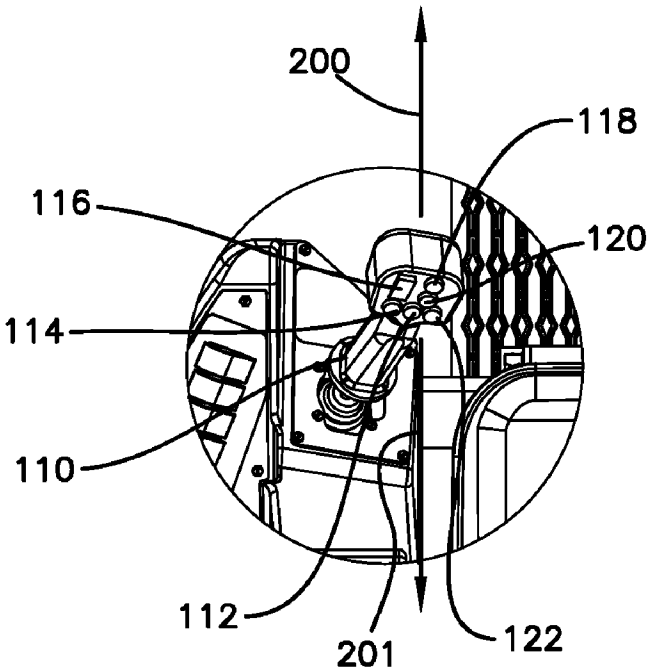
FIG. 3 illustrates a control lever of the operator control station of FIG. 2.

FIG. 3 illustrates the rotational movement control 110 in more detail, showing the various control switches that are mounted on the control, as well as the forward 200 and backward 201 directions. FIG. 4 illustrates a visually perceptible display (e.g., a sign) that indicates the functions of each of the control switches located on the control 110 to the operator. Control 110 includes switches 112, 118, 120, and 122, each of which generates an electrical signal when actuated, such as by being pressed. Control switch 112 may be called a SET switch. When SET switch 112 is actuated, an electrical signal is sent to controller 150 activating an automatic boring mode (also called auto boring mode). When controller 150 receives a signal from SET switch 112, the rotational movement and thrust movement parameters are set within the controller to the values established by the positions of controls 110, 130 at the time that the SET switch 112 is actuated. The preferred technique includes setting a value for the speed of rotation, while setting a value for the pressure in the axial thrust circuit, as will be explained in more detail later. Thereafter, controller 150 automatically maintains the boring parameters of rotational movement and thrust movement at the set values without further input from the operator. Preferably, the operator then may release control levers 110, 130, which will then automatically return to the neutral position within a short period of time, without affecting the boring operation, thereby reducing operator fatigue. The auto boring mode will be deactivated if either the rotation handle 110 or the thrust handle 130 is subsequently moved from the neutral position. It will be appreciated that as an alternative embodiment or as an option, it may be possible to deactivate the system by actuating the SET switch (or some other switch), when the system is currently activated.

In one embodiment, rotational movement control 110 also includes control switches 114 and 116 which control the water flow functions for injecting water into a bored hole to remove cuttings from the hole. Rotational movement control 110 also includes control switches 118 and 120 to control the speed of the engine 36, and control switch 122 to control a greater (not shown).

Figure 6:
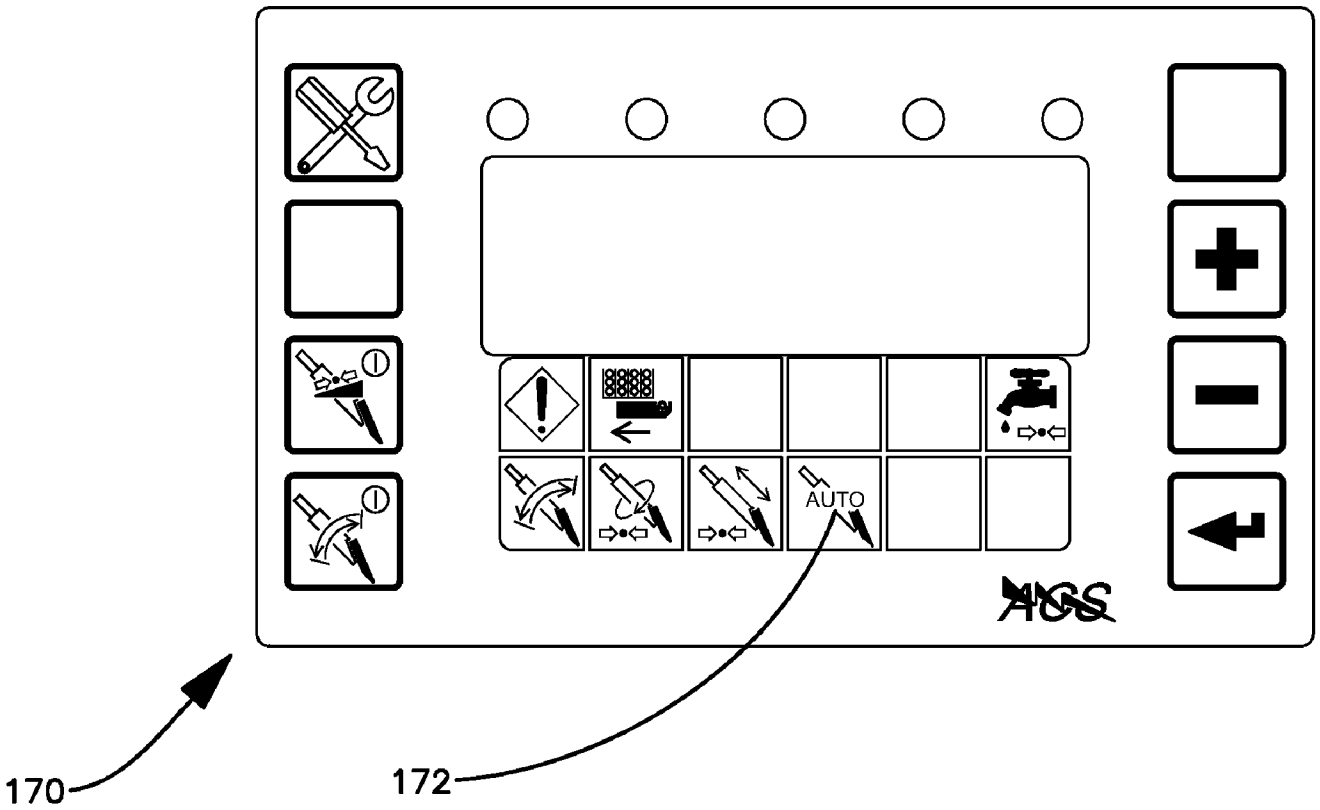
FIG. 6 illustrates a display according to the principles of the present invention.

FIG. 6 illustrates a display 170 for the control system that includes a light 172 that is energized when an auto boring mode is active (e.g., to help alert the user on the status of the system). This light 172 is energized after the SET switch 112 is activated and a rotation setting and a thrust setting are defined, so as to enter the auto boring mode. Light 172 is deactivated if the auto boring mode is not active.

Figure 5:
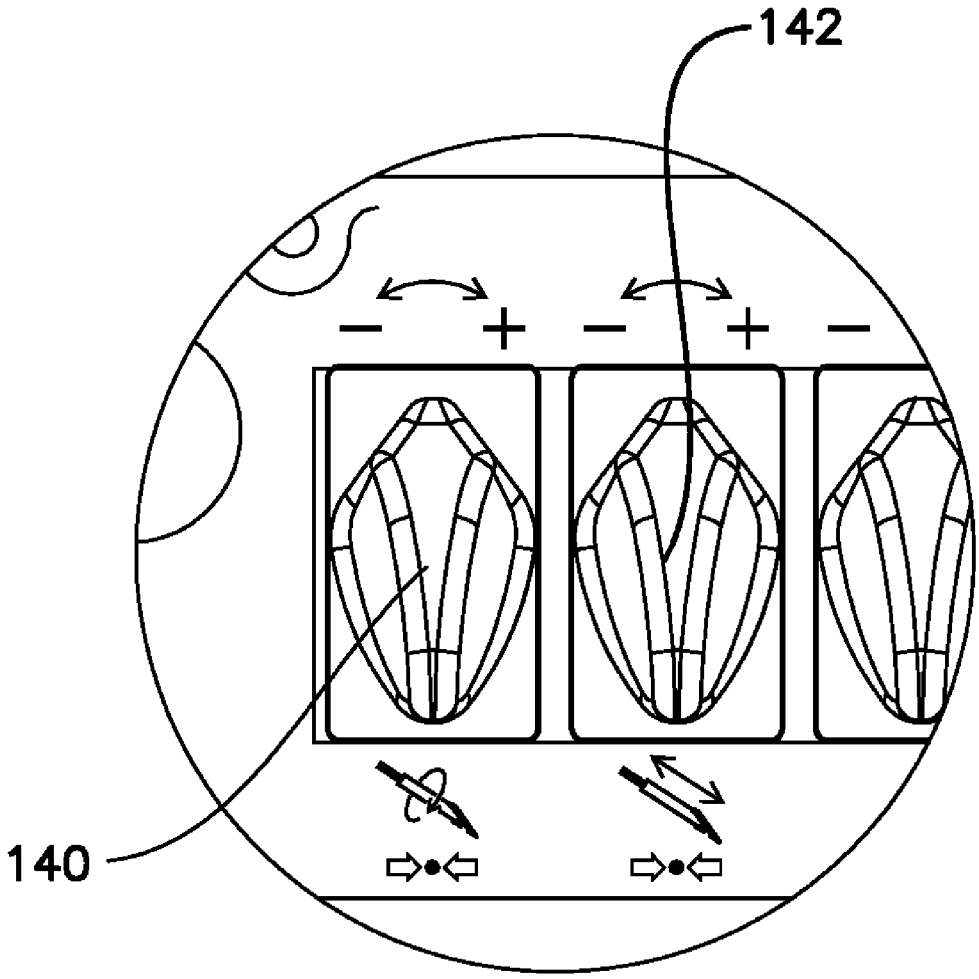
FIG. 5 illustrates controls found on the right side of the operator control station of FIG. 2.

FIG. 5 illustrates additional control switches on the right side of the operator control station 100. In one embodiment, control station 100 includes switches 140, 142 that are in electrical communication with controller 150. Switch 140 has a neutral position, a first operative position, and a second operative position. In one embodiment, switch 140 is spring-loaded to the neutral position, so that when the switch is placed in either the first or second operative positions and then released, switch 140 will return to the neutral position. When switch 140 is in the neutral position, switch 140 has no effect on the boring operation. When switch 140 is placed in the first operative position, such as where switch 140 is rotated clockwise away from the neutral position, and when the auto bore mode is activated, an electrical signal is sent to controller 150 to increase the rotational pressure or movement setting by a predefined increment. Similarly, when switch 140 is placed in the second operative position, such as where switch 140 is rotated counterclockwise away from the neutral position, and when the auto bore mode is activated, an electrical signal is sent to controller 150 to decrease the rotational pressure or movement setting by a predefined decrement.

Operation of switch 142 is similar. Switch 142 has a neutral position, a first operative position, and a second operative position. In one embodiment, switch 142 is spring-loaded to the neutral position, so that when the switch is placed in either the first or second operative positions and then released, switch 142 will return to the neutral position. When switch 142 is in the neutral position, switch 142 has no effect on the boring operation. When switch 142 is placed in the first operative position, such as where switch 142 is rotated clockwise away from the neutral position, and when the auto bore mode is activated, an electrical signal is sent to controller 150 to increase the axial thrust pressure setting by a predefined increment. Similarly, when switch 142 is placed in the second operative position, such as where switch 142 is rotated counterclockwise away from the neutral position, and when the auto bore mode is activated, an electrical signal is sent to controller 150 to decrease the axial thrust pressure setting by a predefined decrement.

During the boring or backreaming processes the system then acts to maintain rotation of the drill string at the selected speed of rotation, independent of the rotational pressure setting and axial pressure setting, and will automatically vary the axial thrust speed as necessary to attempt to maintain the selected pressure in the rotation circuit, or to maintain a set amount of force at the boring tool. In consistent formations maintaining a constant force on the drill bit will result in a constant/consistent torque on the drill bit, and will maximize drilling efficiency. In formations that vary, this same control technique is also effective.

It may be necessary to interrupt the auto boring mode, such as when it is required to add or remove a drill rod from the drill string. There are several ways in which the auto boring mode may be interrupted. The machine 20 may be configured so that when the auto boring mode is activated, as indicated by light 172, any further motion of controls 110, 130 sends an electrical signal to controller 150 that causes controller 150 to interrupt the auto boring mode. Alternatively, other switches or controls may be provided or adapted so as to provide an electrical signal to the controller 150 to interrupt the auto boring mode. One example is a control function related to breaking the connection between the drive chuck of the rotational drive 30 and the drill string. When a drill rod has been completely inserted, and the rotational drive is at the end of the frame 22, then the rotational drive must be unthreaded from the drill string and moved back to the opposite end of the frame so that another drill rod can be added. This action is required when the rotational drive is located at certain positions along the frame, for instance at the extreme opposite ends. Thus, an interrupt signal can be provided automatically by a sensor that measures the position of the thrust drive. When the interrupt signal is received it may also automatically cancel other functions such as the water flow.

The operator control station 100 also includes switch 144 that is in electrical communication with controller 150. Switch 144 may be called a RESUME switch. When the auto boring mode has been interrupted, the operator may actuate switch 144 to resume the auto boring mode. Switch 144 then sends an electrical signal to controller 150 that causes controller 150 to resume the auto boring mode at the same settings as existed prior to the auto boring mode being interrupted.

Figure 8:
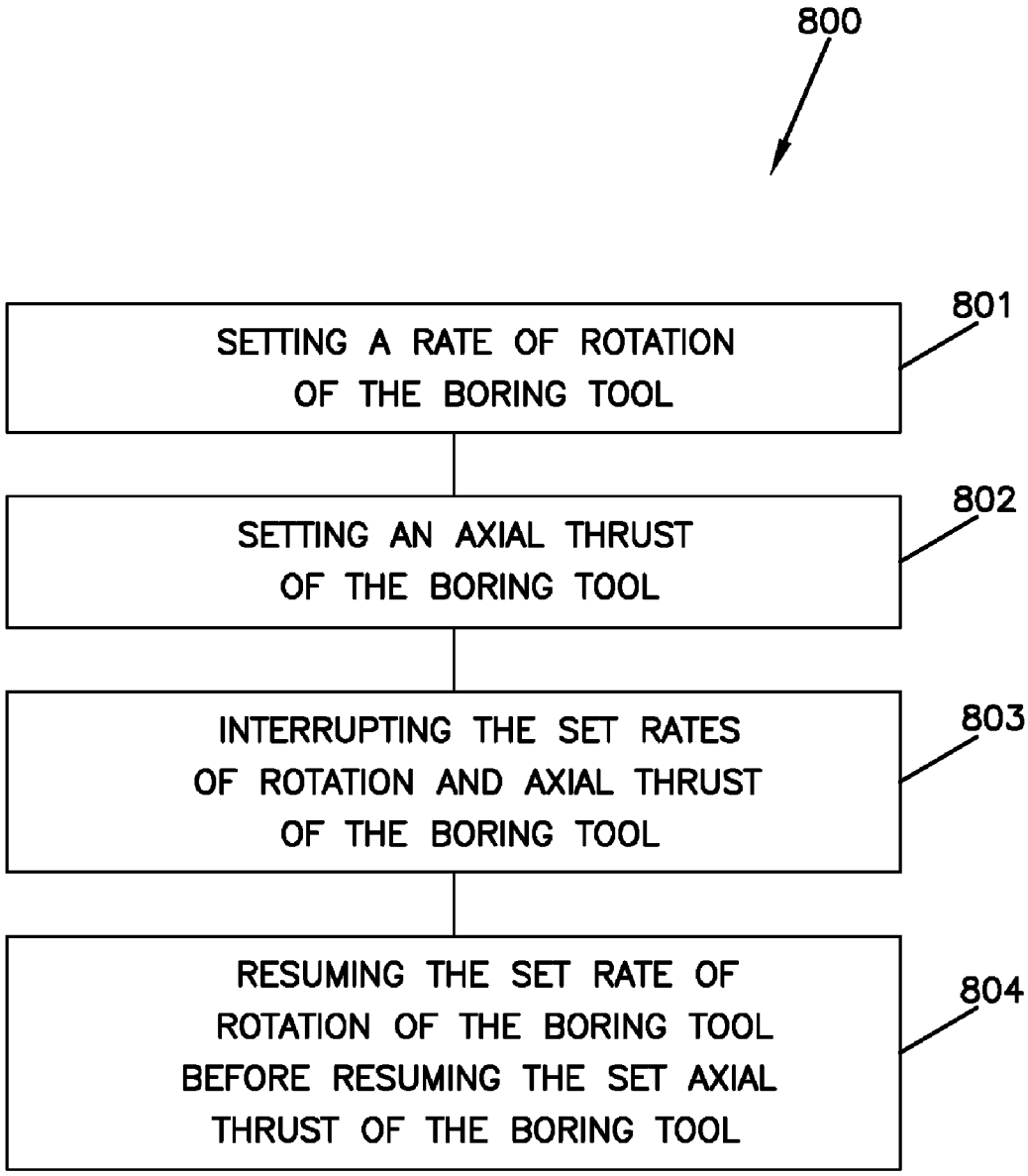
FIG. 8 is a flow diagram of a method of resuming automatic control of boring functions.

A preferred method which implements the principles of the present invention is shown in FIG. 8, where the method is generally designated at 800. At block 801, a rate of rotation is of the boring tool 42 is set. The axial thrust of the boring tool 42 is set at block 802. At block 803, the set rates of rotation and axial thrust are interrupted, while at block 804, the resume process is implemented.

Figure 7:
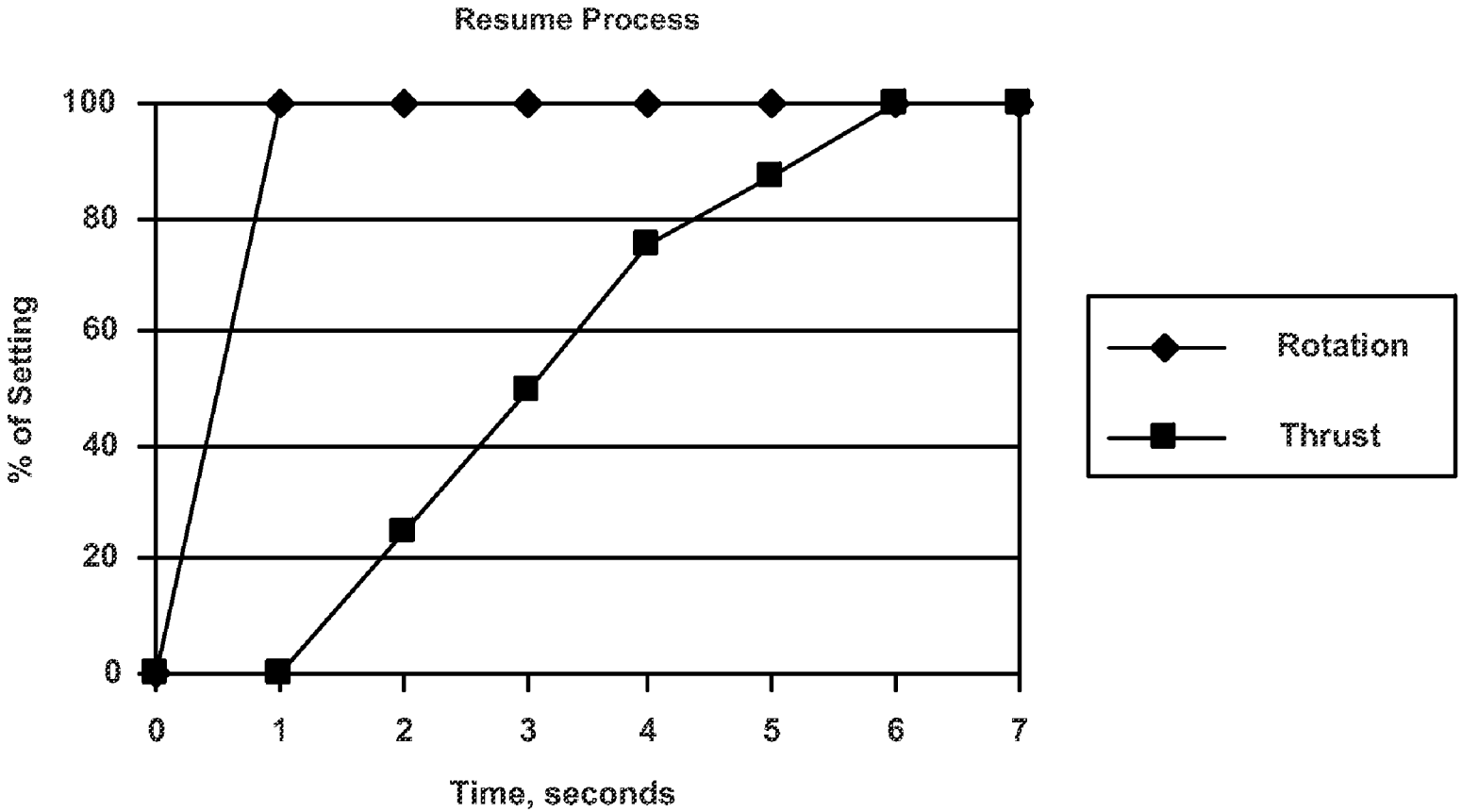
FIG. 7 illustrates the rates of increase of rotational movement and axial thrust when a boring process is resumed.

Many embodiments of the resume process are usable. The resume process of the present invention initiates drilling operation in a manner that minimizes unnecessary vibration and stress in the drill string and drilling tool. FIGS. 7 and 8 illustrate one usable embodiment of the resume process. The resume process begins (at time equal to 0 seconds) when the switch 144 is depressed to initiate the resume process, sending an electrical signal to the controller 150. The controller 150 will activate the rotational drive mechanism so as to bring the boring tool to the set value of rotational movement, the set rate of rotation. At the same time, preferably the water flow is automatically restarted (not shown). The resumption of rotational movement occurs rather quickly, usually in about one second. During the time that the rotation is being resumed, controller 150 does not activate the thrust drive mechanism. In this way, the boring tool 42 will resume rotation to the set rate of rotation while there is little or no longitudinal thrust loading or movement. This operation is advantageous because it produces a smooth rotational acceleration without shock loading of the boring tool and drill string. There are additional benefits to reestablish water flow to the cutting tool prior to new cuttings being generated from axial movement of the drill string.

After the rotational movement setting is attained, approximately one second after the rotation is started, the controller 150 then beings to apply thrust force to the drill string. However, rather than rapidly increasing the thrust force to the set value, the thrust force is increased from zero to the set value, the set axial thrust, at a predetermined rate. In one usable embodiment, the thrust force is applied at a first constant rate of 25% of the set axial thrust force setting per second for three seconds, from the time of one second after the resume process is initiated to the time of four seconds after the resume process is initiated. Thus, having increased by 25% of the thrust force setting for three (3) seconds, the amount of thrust force applied at this point will be 75% of the thrust force setting. The thrust force is then applied at a second constant rate of 12.5% per second for two seconds. Under this resumption example, from the time of four (4) seconds after the resume process is initiated to the time of six (6) seconds after the resume process is initiated, the thrust force is increased from 75% of the set value to 100% of the set value. Thus, at six (6) seconds after the resume process is initiated, the boring tool will be operating both at the set rate of rotation and the set axial thrust.

An alternative embodiment includes increasing the axial thrust force at a single predetermined rate, such as 25% of the set axial thrust force per second for four (4) seconds. It will be appreciated that other rates may also be used, and that the rates provided herein are presented as preferred embodiments, and not as limitations.

While particular embodiments of the invention have been described with respect to its application, it will be understood by those skilled in the art that the invention is not limited by such application or embodiment or the particular components disclosed and described herein. It will be appreciated by those skilled in the art that other components that embody the principles of this invention and other applications therefor other than as described herein can be configured within the spirit and intent of this invention. The arrangement described herein is provided as only one example of an embodiment that incorporates and practices the principles of this invention.

Other modifications and alterations are well within the knowledge of those skilled in the art and are to be included within the broad scope of the appended claims.

What is claimed is:

1. A method for controlling an underground boring tool comprising:

setting a rate of rotation and a rate of axial movement of the boring tool;

interrupting the set rate of rotation and the set rate of axial movement of the boring tool;

starting to resume the set rate of axial movement after first starting to resume the set rate of rotation, and wherein the set rate of axial movement is resumed at a controlled rate.

2. The method of claim 1 wherein the set rate of rotation is fully resumed before the set rate of axial movement is fully resumed.

3. The method of claim 1, wherein starting to resume the set rate of axial movement occurs at least one second after starting to resume the set rate of rotation.

4. The method of claim 3, wherein the set rate of rotation is fully resumed before starting to resume the set rate of axial movement.

5. The method of claim 1, wherein a time period of at least four seconds occur between starting to resume the set rate of axial movement and fully resuming the set rate of axial movement.

6. The method of claim 1, wherein the set rate of axial movement is resumed in at least two different rates.

7. The method of claim 6, wherein the set rate of axial movement is resumed at a rate, the set rate of axial movement is directly proportional to a flow rate from a hydraulic pump, and the flow rate is varied to change the rate at which the axial movement is resumed.

8. The method of claim 6, wherein an initial rate of resuming the set rate of axial movement is greater than a final rate of resuming the set rate of axial movement.

9. The method of claim 8, wherein initial rate of resuming the set rate of axial movement divided by the set rate of axial movement is greater than twenty percent and the final rate of resuming axial movement divided by the set rate of axial movement is less than twenty percent.

10. The method of claim 9, wherein the initial rate of resuming the set rate of axial movement is greater than twenty percent of the set rate of axial movement for at least two seconds.

11. The method of claim 9, wherein the initial rate of resuming axial movement is twenty-five percent of the set rate of axial movement for three seconds and twelve and a half percent of the set rate of axial movement for two seconds.

12. A method for controlling an underground boring tool comprising:

setting a rate of rotation and a rate of axial movement of the boring tool;

interrupting the set rate of rotation and the set rate of axial movement of the boring tool;

starting to resume the set rate of axial movement at an acceleration rate that is controlled by a control system.

13. The method of claim 12, wherein the interrupting step includes stopping the rotation and axial movement of the boring tool.

14. The method of claim 12, wherein an initially resumed rate of axial movement is increased to that of the set rate of axial movement at an acceleration rate that is controlled by the control system.

15. The method of claim 12, wherein an initially resumed rate of axial movement is fully resumed to that of the set rate of axial movement at an acceleration rate that is controlled by the control system, wherein the control system changes the acceleration rate between the starting of the resuming step and an end of the resuming step.

16. The method of claim 12, wherein the acceleration rate produces a linear increase in the rate of axial movement.

17. The method of claim 12, wherein the acceleration rate changes at least once before the set rate of axial movement is fully resumed.

18. A method for controlling an underground boring tool comprising:

setting a rate of rotation of the boring tool;

boring at the set rate of rotation;

interrupting the set rate of rotation;

starting to resume the set rate of rotation at an acceleration rate that is controlled by a control system.

19. The method of claim 18, wherein the interrupting step includes stopping the rotation of the boring tool.

20. The method of claim 18, wherein the rate of rotation of the boring tool is fully resumed to that of the set rate of rotation at an acceleration rate that is controlled by the control system.

* * * * *

UNITED STATES PATENT AND TRADEMARK OFFICE

CERTIFICATE OF CORRECTION

PATENT NO. : 8,235,142 B2
APPLICATION NO. : 12/785985
DATED : August 7, 2012
INVENTOR(S) : Carlson et al.

It is certified that error appears in the above-identified patent and that said Letters Patent is hereby corrected as shown below:

Col. 5, line 6: "greater for lubricating" should read --greaser for lubricating--

Col. 6, line 42: "greater (not shown)." should read --greaser (not shown).--

Col. 9, line 25, claim 5: "seconds occur between" should read --seconds occurs between--

Col. 9, line 38, claim 9: "wherein initial rate of" should read --wherein the initial rate of--

Signed and Sealed this
Fifth Day of February, 2013

Teresa Stanek Rea
*Acting Director of the United States Patent and Trademark Office*